US010672411B2

(12) United States Patent
Baeckstroem et al.

(10) Patent No.: US 10,672,411 B2
(45) Date of Patent: Jun. 2, 2020

(54) METHOD FOR ADAPTIVELY ENCODING AN AUDIO SIGNAL IN DEPENDENCE ON NOISE INFORMATION FOR HIGHER ENCODING ACCURACY

(71) Applicant: Fraunhofer-Gesellschaft zur Foerderung der angewandten Forschung e.V., Munich (DE)

(72) Inventors: Tom Baeckstroem, Helsinki (FI); Emma Jokinen, Helsinki (FI)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/725,115

(22) Filed: Oct. 4, 2017

(65) Prior Publication Data

US 2018/0033444 A1 Feb. 1, 2018

Related U.S. Application Data

(63) Continuation of application No. PCT/EP2016/057514, filed on Apr. 6, 2016.

(30) Foreign Application Priority Data

Apr. 9, 2015 (EP) ..... 15163055

(51) Int. Cl.
*G10L 19/08* (2013.01)
*G10L 19/032* (2013.01)
(Continued)

(52) U.S. Cl.
CPC ..... *G10L 19/08* (2013.01); *G10L 19/032* (2013.01); *G10L 21/0232* (2013.01); *G10L 2019/0011* (2013.01)

(58) Field of Classification Search
CPC ..... G10L 19/08; G10L 19/12; G10L 19/13; G10L 21/02; G10L 21/0224; G10L 21/0232; G10L 2019/0001; G10L 19/032
(Continued)

(56) References Cited

U.S. PATENT DOCUMENTS 4,133,976 A 1/1979 Atal et al.
5,105,463 A * 4/1992 Veldhuis ..... H04B 1/667 704/200.1
(Continued)

FOREIGN PATENT DOCUMENTS

JP 2001109496 A 4/2001
RU 2469419 C2 12/2012
(Continued)

OTHER PUBLICATIONS

Atal, Bishnu S. et al., "Predictive coding of speech signals and subjective error criteria", Acoustics, Speech and Signal Processing, IEEE Transactions on 27.3 (1979), 1979, pp. 247-254.
(Continued)

*Primary Examiner* — Martin Lerner
(74) *Attorney, Agent, or Firm* — Perkins Coie LLP; Michael A. Glenn

(57) ABSTRACT

An audio encoder for providing an encoded representation on the basis of an audio signal, wherein the audio encoder is configured to obtain a noise information describing a noise included in the audio signal, and wherein the audio encoder is configured to adaptively encode the audio signal in dependence on the noise information, such that encoding accuracy is higher for parts of the audio signal that are less affected by the noise included in the audio signal than for parts of the audio signal that are more affected by the noise included in the audio signal.

22 Claims, 7 Drawing Sheets

(51) Int. Cl.
*G10L 19/13* (2013.01)
*G10L 21/0232* (2013.01)
*G10L 19/00* (2013.01)

(58) Field of Classification Search
USPC ..... 704/219, 220, 221, 222, 225, 226, 230, 704/200.1
See application file for complete search history.

(56) References Cited

U.S. PATENT DOCUMENTS 5,369,724 A * 11/1994 Lim ..... G10L 19/0208 704/200.1
5,621,853 A * 4/1997 Gardner ..... G10L 19/12 704/219
5,680,508 A 10/1997 Liu
5,790,759 A * 8/1998 Chen ..... G10L 19/0212 704/200.1
5,845,244 A 12/1998 Proust
5,848,387 A * 12/1998 Nishiguchi ..... G10L 19/06 704/214
6,167,375 A * 12/2000 Miseki ..... G10L 19/012 704/224
6,298,322 B1 * 10/2001 Lindemann ..... G10L 19/02 704/200.1
6,385,573 B1 5/2002 Su et al.
6,523,003 B1 * 2/2003 Chandran ..... G10L 21/0208 704/225
6,704,705 B1 * 3/2004 Kabal ..... G10L 19/032 704/230
7,392,180 B1 6/2008 Accardi et al.
8,724,828 B2 * 5/2014 Furuta ..... G10L 21/0232 327/551
8,781,842 B2 * 7/2014 Taleb ..... G10L 19/04 704/500
2001/0001140 A1 5/2001 Accardi et al.
2002/0116182 A1 8/2002 Su et al.
2002/0143527 A1 * 10/2002 Gao ..... G10L 19/18 704/223
2006/0116874 A1 6/2006 Samuelsson et al.
2008/0015855 A1 * 1/2008 Suzuki ..... G10L 19/032 704/230
2008/0312916 A1 12/2008 Konchitsky et al.
2009/0265167 A1 10/2009 Ehara et al.
2010/0174538 A1 * 7/2010 Vos ..... G10L 19/02 704/219
2011/0076968 A1 * 3/2011 Seshadri ..... G10L 19/12 704/227
2012/0253797 A1 * 10/2012 Geiger ..... G10L 19/083 704/219
2013/0030800 A1 1/2013 Tracey et al.
2013/0308001 A1 11/2013 Jelinek
2014/0214413 A1 * 7/2014 Atti ..... G10L 19/26 704/219
2018/0075854 A1 3/2018 Bruhn

FOREIGN PATENT DOCUMENTS

WO 9425959 A1 11/1994
WO 2005031709 A1 4/2005

OTHER PUBLICATIONS

Chen, Juin-Hwey et al., "Real-time vector APC speech coding at 4800 bps with adaptive postfiltering", Acoustics, Speech and Signal Processing, IEEE International Conference on ICASSP'87.; vol. 12, IEEE, 1987.
Raju, P. et al., "A modified EVRC algorithm for enhanced noise suppression and increased robustness", International Conference on Multimedia, Signal Processing and Communication Technologies (IMPACT); 2011, XP032115138, Dec. 17, 2011, pp. 260-263.

* cited by examiner

METHOD FOR ADAPTIVELY ENCODING AN AUDIO SIGNAL IN DEPENDENCE ON NOISE INFORMATION FOR HIGHER ENCODING ACCURACY

CROSS-REFERENCE TO RELATED APPLICATIONS

This application is a continuation of copending International Application No. PCT/EP2016/057514, filed Apr. 6, 2016, which is incorporated herein by reference in its entirety, and additionally claims priority from European Application No. EP 15 163 055.5, filed Apr. 9, 2015, which is incorporated herein by reference in its entirety.

Embodiments relate to an audio encoder for providing an encoded representation on the basis of an audio signal. Further embodiments relate to a method for providing an encoded representation on the basis of an audio signal. Some embodiments relate to a low-delay, low-complexity, far-end noise suppression for perceptual speech and audio codecs.

BACKGROUND OF THE INVENTION

A current problem with speech and audio codecs is that they are used in adverse environments where the acoustic input signal is distorted by background noise and other artifacts. This causes several problems. Since the codec now has to encode both the desired signal and the undesired distortions, the coding problem is more complicated because the signal now consists of two sources and that will decrease encoding quality. But even if we could encode the combination of the two courses with the same quality as a single clean signal, the speech part would still be lower quality than the clean signal. The lost encoding quality is not only perceptually annoying but, importantly, it also increases listening effort and, in the worst case, decreases the intelligibility or increases the listening effort of the decoded signal.

WO 2005/031709 A1 shows a speech coding method applying noise reduction by modifying the codebook gain. In detail, an acoustic signal containing a speech component and a noise component is encoded by using an analysis through synthesis method, wherein for encoding the acoustic signal a synthesized signal is compared with the acoustic signal for a time interval, said synthesized signal being described by using a fixed codebook and an associated fixed gain.

US 2011/076968 A1 shows a communication device with reduced noise speech coding. The communication device includes a memory, an input interface, a processing module, and a transmitter. The processing module receives a digital signal from the input interface, wherein the digital signal includes a desired digital signal component and an undesired digital signal component. The processing module identifies one of a plurality of codebooks based on the undesired digital signal component. The processing module then identifies a codebook entry from the one of the plurality of codebooks based on the desired digital signal component to produce a selected codebook entry. The processing module then generates a coded signal based on the selected codebook entry, wherein the coded signal includes a substantially unattenuated representation of the desired digital signal component and an attenuated representation of the undesired digital signal component US 2001/001140 A1 shows a modular approach to speech enhancement with an application to speech coding. A speech coder separates input digitized speech into component parts on an interval by interval basis. The component parts include gain components, spectrum components and excitation signal components. A set of speech enhancement systems within the speech coder processes the component parts such that each component part has its own individual speech enhancement process. For example, one speech enhancement process can be applied for analyzing the spectrum components and another speech enhancement process can be used for analyzing the excitation signal components.

U.S. Pat. No. 5,680,508 A discloses an enhancement of speech coding in background noise for low-rate speech coder. A speech coding system employs measurements of robust features of speech frames whose distribution are not strongly affected by noise/levels to make voicing decisions for input speech occurring in a noisy environment. Linear programing analysis of the robust features and respective weights are used to determine an optimum linear combination of these features. The input speech vectors are matched to a vocabulary of codewords in order to select the corresponding, optimally matching codeword. Adaptive vector quantization is used in which a vocabulary of words obtained in a quiet environment is updated based upon a noise estimate of a noisy environment in which the input speech occurs, and the "noisy" vocabulary is then searched for the best match with an input speech vector. The corresponding clean codeword index is then selected for transmission and for synthesis at the receiver end.

US 2006/116874 A1 shows a noise-dependent postfiltering. A method involves providing a filter suited for reduction of distortion caused by speech coding, estimating acoustic noise in the speech signal, adapting the filter in response to the estimated acoustic noise to obtain an adapted filter, and applying the adapted filter to the speech signal so as to reduce acoustic noise and distortion caused by speech coding in the speech signal.

U.S. Pat. No. 6,385,573 B1 shows an adaptive tilt compensation for synthesized speech residual. A multi-rate speech codec supports a plurality of encoding bit rate modes by adaptively selecting encoding bit rate modes to match communication channel restrictions. In higher bit rate encoding modes, an accurate representation of speech through CELP (code excited linear prediction) and other associated modeling parameters are generated for higher quality decoding and reproduction. To achieve high quality in lower bit rate encoding modes, the speech encoder departs from the strict waveform matching criteria of regular CELP coders and strives to identify significant perceptual features of the input signal.

U.S. Pat. No. 5,845,244 A relates to adapting noise masking level in analysis-by-synthesis employing perceptual weighting. In an analysis-by-synthesis speech coder employing a short-term perceptual weighting filter, the values of the spectral expansion coefficients are adapted dynamically on the basis of spectral parameters obtained during short-term linear prediction analysis. The spectral parameters serving in this adaptation may in particular comprise parameters representative of the overall slope of the spectrum of the speech signal, and parameters representative of the resonant character of the short-term synthesis filter U.S. Pat. No. 4,133,976 A shows a predictive speech signal coding with reduced noise effects. A predictive speech signal processor features an adaptive filter in a feedback network around the quantizer. The adaptive filter essentially combines the quantizing error signal, the formant related prediction parameter signals and the difference signal to concentrate the quantizing error noise in spectral peaks corresponding to the time-varying formant portions of the speech spectrum so that the quantizing noise is masked by the speech signal formants.

WO 9425959 A1 shows use of an auditory model to improve quality or lower the bit rate of speech synthesis systems. A weighting filter is replaced with an auditory model which enables the search for the optimum stochastic code vector in the psychoacoustic domain. An algorithm, which has been termed PERCELP (for Perceptually Enhanced Random Codebook Excited Linear Prediction), is disclosed which produces speech that is of considerably better quality than obtained with a weighting filter.

US 2008/312916 A1 shows a receiver intelligibility enhancement system, which processes an input speech signal to generate an enhanced intelligent signal. In frequency domain, the FFT spectrum of the speech received from the far-end is modified in accordance with the LPC spectrum of the local background noise to generate an enhanced intelligent signal. In time domain, the speech is modified in accordance with the LPC coefficients of the noise to generate an enhanced intelligent signal.

US 2013/030800 1A shows an adaptive voice intelligibility processor, which adaptively identifies and tracks formant locations, thereby enabling formants to be emphasized as they change. As a result, these systems and methods can improve near-end intelligibility, even in noisy environments.

In [Atal, Bishnu S., and Manfred R. Schroeder. "Predictive coding of speech signals and subjective error criteria". Acoustics, Speech and Signal Processing, IEEE Transactions on 27.3 (1979): 247-254] methods for reducing the subjective distortion in predictive coders for speech signals are described and evaluated. Improved speech quality is obtained: 1) by efficient removal of formant and pitch-related redundant structure of speech before quantizing, and 2) by effective masking of the quantizer noise by the speech signal.

In [Chen, Juin-Hwey and Allen Gersho. "Real-time vector APC speech coding at 4800 bps with adaptive postfiltering". Acoustics, Speech and Signal Processing, IEEE International Conference on ICASSP'87. Vol. 12, IEEE, 1987] an improved Vector APC (VAPC) speech coder is presented, which combines APC with vector quantization and incorporates analysis-by-synthesis, perceptual noise weighting, and adaptive postfiltering.

SUMMARY

An embodiment may have an audio encoder for providing an encoded representation on the basis of an audio signal, wherein the audio encoder is configured to acquire a noise information describing a noise included in the audio signal, and wherein the audio encoder is configured to adaptively encode the audio signal in dependence on the noise information, such that encoding accuracy is higher for parts of the audio signal that are less affected by the noise included in the audio signal than for parts of the audio signal that are more affected by the noise included in the audio signal; wherein frequency components that are less corrupted by the noise are quantized with less error whereas components which are likely to contain errors from the noise have a lower weight in the quantization process.

According to another embodiment, a method for providing an encoded representation on the basis of an audio signal may have the steps of: acquiring a noise information describing a noise included in the audio signal; and adaptively encoding the audio signal in dependence on the noise information, such that encoding accuracy is higher for parts of the audio signal that are less affected by the noise included in the audio signal than parts of the audio signal that are more affected by the noise included in the audio signal, wherein frequency components that are less corrupted by the noise are quantized with less error whereas components which are likely to contain errors from the noise having a lower weight in the quantization process.

Another embodiment may have a non-transitory digital storage medium having a computer program stored thereon to perform the method for providing an encoded representation on the basis of an audio signal, the method including: acquiring a noise information describing a noise included in the audio signal; and adaptively encoding the audio signal in dependence on the noise information, such that encoding accuracy is higher for parts of the audio signal that are less affected by the noise included in the audio signal than parts of the audio signal that are more affected by the noise included in the audio signal, wherein frequency components that are less corrupted by the noise are quantized with less error whereas components which are likely to contain errors from the noise having a lower weight in the quantization process, when said computer program is run by a computer.

Another embodiment may have a data stream carrying an encoded representation of an audio signal, wherein the encoded representation of the audio signal adaptively codes the audio signal in dependence on a noise information describing a noise included in the audio signal, such that encoding accuracy is higher for parts of the audio signal that are less affected by the noise included in the audio signal than parts of the audio signal that are more affected by the noise included in the audio signal, wherein frequency components that are less corrupted by the noise are quantized with less error whereas components which are likely to contain errors from the noise having a lower weight in the quantization process.

Another embodiment may have an audio encoder for providing an encoded representation on the basis of an audio signal, wherein the audio encoder is configured to acquire a noise information describing a background noise, and wherein the audio encoder is configured to adaptively encode the audio signal in dependence on the noise information by adjusting, in dependence on the noise information, a perceptual weighting filter used for encoding the audio signal; wherein the audio signal is a speech signal, and wherein the audio encoder is configured to derive a residual signal from the speech signal and to encode the residual signal using a codebook; wherein the audio encoder is configured to select a codebook entry of a plurality of codebook entries of a codebook for encoding the residual signal in dependence on the noise information; wherein the audio encoder is configured to adjust the perceptual weighing filter such that parts of the speech signal that are less affected by the noise are weighted more for the selection of the codebook entry than parts of the speech signal that are more affected by the noise; wherein the audio encoder is configured to select the codebook entry for the residual signal such that a synthesized weighted quantization error of the residual signal weighted with the perceptual weighting filter W is reduced or minimized.

Another embodiment may have an audio encoder for providing an encoded representation on the basis of an audio signal, wherein the audio encoder is configured to acquire a noise information describing a noise included in the audio signal, and wherein the audio encoder is configured to adaptively encode the audio signal in dependence on the noise information, such that encoding accuracy is higher for parts of the audio signal that are less affected by the noise included in the audio signal than for parts of the audio signal that are more affected by the noise included in the audio signal; wherein the audio signal is a speech signal, and wherein the audio encoder is configured to derive a residual signal from the speech signal and to encode the residual signal using a codebook; wherein the audio encoder is configured to select a codebook entry of a plurality of codebook entries of a codebook for encoding the residual signal in dependence on the noise information; wherein the audio encoder is configured to select the codebook entry using a perceptual weighting filter; wherein the audio encoder is configured to adjust the perceptual weighing filter such that parts of the speech signal that are less affected by the noise are weighted more for the selection of the codebook entry than parts of the speech signal that are more affected by the noise; wherein the audio encoder is configured to select the codebook entry for the residual signal such that a synthesized weighted quantization error of the residual signal weighted with the perceptual weighting filter W is reduced or minimized.

Another embodiment may have an audio encoder for providing an encoded representation on the basis of an audio signal, wherein the audio encoder is configured to acquire a noise information describing a noise included in the audio signal, and wherein the audio encoder is configured to adaptively encode the audio signal in dependence on the noise information, such that encoding accuracy is higher for parts of the audio signal that are less affected by the noise included in the audio signal than for parts of the audio signal that are more affected by the noise included in the audio signal; wherein the audio signal is a speech signal, and wherein the audio encoder is configured to derive a residual signal from the speech signal and to encode the residual signal using a codebook; wherein the audio encoder is configured to select a codebook entry of a plurality of codebook entries of a codebook for encoding the residual signal in dependence on the noise information; wherein the audio encoder is configured to derive linear prediction coefficients from the noise information, to thereby determine a linear prediction fit ($A_{BCK}$), and to use the linear prediction fit ($A_{BCK}$) in the perceptual weighting filter; and wherein the audio encoder is configured to adjust the perceptual weighting filter using the formula: $W(z)=A(z/\gamma_1)A_{BCK}(z/\gamma_2)H_{de\text{-}emph}(z)$, wherein W represents the perceptual weighting filter, wherein A represents a vocal tract model, $A_{BCK}$ represents the linear prediction fit, $H_{de\text{-}emph}$ represents a quantized vocal tract synthesis filter, $\gamma_1=0.92$, and $\gamma_2$ is a parameter with which an amount of noise suppression is adjustable.

Embodiments provide an audio encoder for providing an encoded representation on the basis of an audio signal. The audio encoder is configured to obtain a noise information describing a noise included in the audio signal, wherein the audio encoder is configured to adaptively encode the audio signal in dependence on the noise information, such that encoding accuracy is higher for parts of the audio signal that are less affected by the noise included in the audio signal than for parts of the audio signal that are more affected by the noise included in the audio signal.

According to the concept of the present invention, the audio encoder adaptively encodes the audio signal in dependence on the noise information describing the noise included in the audio signal, in order to obtain a higher encoding accuracy for those parts of the audio signal, which are less affected by the noise (e.g., which have a higher signal-to-noise ratio), than for parts of the audio signal, which are more affected by the noise (e.g., which have a lower signal-to-noise ratio).

Communication codecs frequently operate in environments where the desired signal is corrupted by background noise. Embodiments disclosed herein address situations where the sender/encoder side signal has background noise already before coding.

For example, according to some embodiments, by modifying the perceptual objective function of a codec the coding accuracy of those portions of the signal which have higher signal-to-noise ratio (SNR) can be increased, thereby retaining quality of the noise-free portions of the signal. By saving the high SNR portions of the signal, an intelligibility of the transmitted signal can be improved and the listening effort can be decreased. While conventional noise suppression algorithms are implemented as a pre-processing block to the codec, the current approach has two distinct advantages. First, by joint noise-suppression and encoding tandem effects of suppression and coding can be avoided. Second, since the proposed algorithm can be implemented as a modification of perceptual objective function, it is of very low computational complexity. Moreover, often communication codecs estimate background noise for comfort noise generators in any case, whereby a noise estimate is already available in the codec and it can be used (as noise information) at no extra computational cost.

Further embodiments relate to a method for providing an encoded representation on the basis of an audio signal. The method comprises obtaining a noise information describing a noise included in the audio signal and adaptively encoding the audio signal in dependence on the noise information, such that encoding accuracy is higher for parts of the audio signal that are less affected by the noise included in the audio signal than for parts of the audio signal that are more affected by the noise included in the audio signal.

Further embodiments relate to a data stream carrying an encoded representation of an audio signal, wherein the encoded representation of the audio signal adaptively codes the audio signal in dependence on a noise information describing a noise included in the audio signal, such that encoding accuracy is higher for parts of the audio signal that are less affected by the noise included in the audio signal than for parts of the audio signal that are more affected by the noise included in the audio signal.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
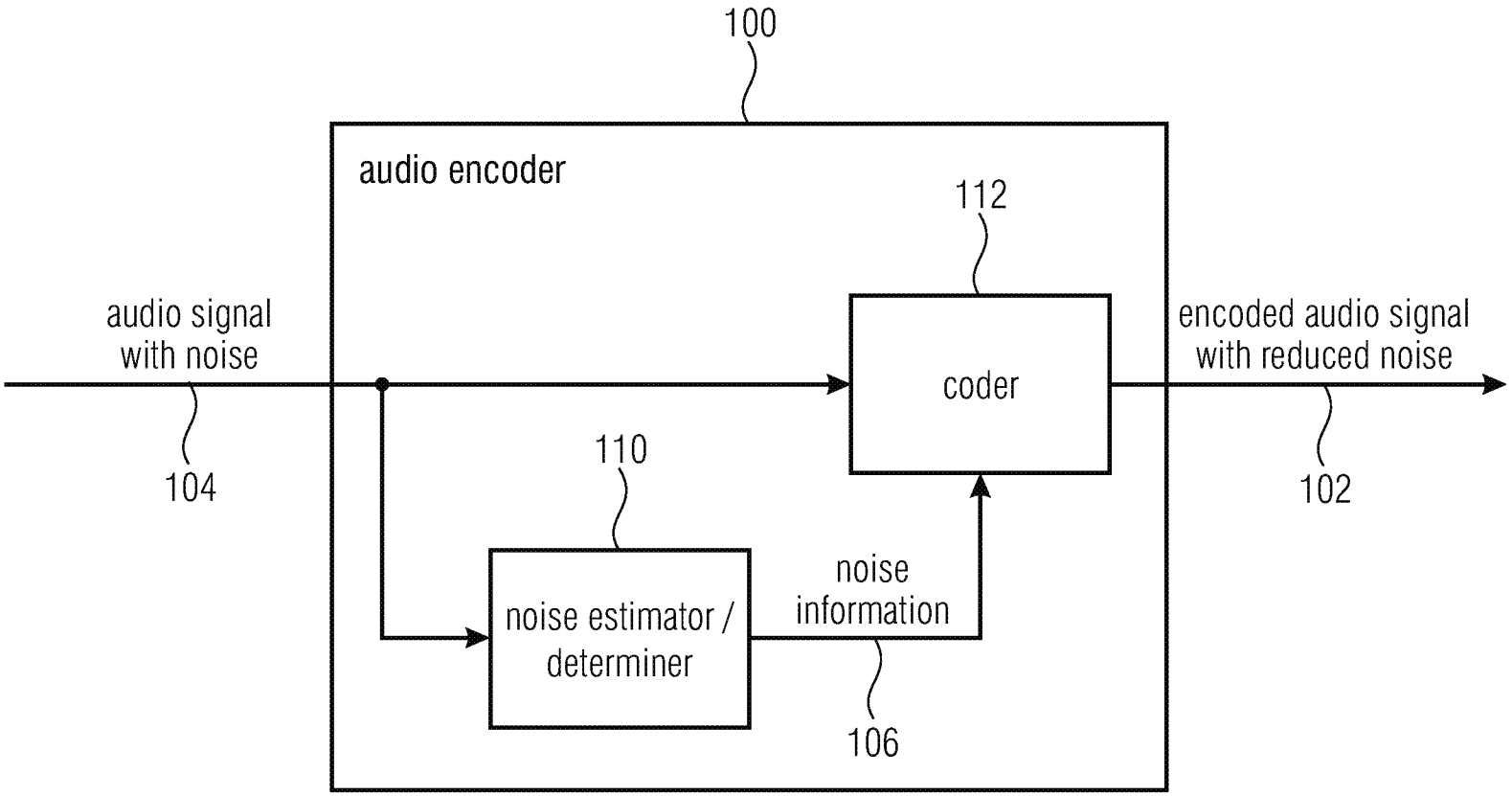
FIG. 1 shows a schematic block diagram of an audio encoder for providing an encoded representation on the basis of an audio signal, according to an embodiment.

Equal or equivalent elements or elements with equal or equivalent functionality are denoted in the following description by equal or equivalent reference numerals.

In the following description, a plurality of details are set forth to provide a more thorough explanation of embodiments of the present invention. However, it will be apparent to one skilled in the art that embodiments of the present invention may be practiced without these specific details. In other instances, well-known structures and devices are shown in block diagram form rather than in detail in order to avoid obscuring embodiments of the present invention. In addition, features of the different embodiments described hereinafter may be combined with each other unless specifically noted otherwise.

FIG. 1 shows a schematic block diagram of an audio encoder 100 for providing an encoded representation (or encoded audio signal) 102 on the basis of an audio signal 104. The audio encoder 100 is configured to obtain a noise information 106 describing a noise included in the audio signal 104 and to adaptively encode the audio signal 104 in dependence on the noise information 106 such that encoding accuracy is higher for parts of the audio signal 104 that are less affected by the noise included in the audio signal 104 than for parts of the audio signal that are more affected by the noise included in the audio signal 104.

For example, the audio encoder 100 can comprise a noise estimator (or noise determiner or noise analyzer) 110 and a coder 112. The noise estimator 110 can be configured to obtain the noise information 106 describing the noise included in the audio signal 104. The coder 112 can be configured to adaptively encode the audio signal 104 in dependence on the noise information 106 such that encoding accuracy is higher for parts of the audio signal 104 that are less affected by the noise included in the audio signal 104 than for parts of the audio signal 104 that are more affected by the noise included in the audio signal 104.

The noise estimator 110 and the coder 112 can be implemented by (or using) a hardware apparatus such as, for example, an integrated circuit, a field programmable gate array, a microprocessor, a programmable computer or an electronic circuit.

In embodiments, the audio encoder 100 can be configured to simultaneously encode the audio signal 104 and reduce the noise in the encoded representation 102 of the audio signal 104 (or encoded audio signal) by adaptively encoding the audio signal 104 in dependence on the noise information 106.

In embodiments, the audio encoder 100 can be configured to encode the audio signal 104 using a perceptual objective function. The perceptual objective function can be adjusted (or modified) in dependence on the noise information 106, thereby adaptively encoding the audio signal 104 in dependence on the noise information 106. The noise information 106 can be, for example, a signal-to-noise ratio or an estimated shape of the noise included in the audio signal 104.

Embodiments of the present invention attempt to decrease listening effort or respectively increase intelligibility. Here it is important to note that embodiments may not in general provide the most accurate possible representation of the input signal but try to transmit such parts of the signal that listening effort or intelligibility is optimized. Specifically, embodiments may change the timbre of the signal, but in such a way that the transmitted signal reduces listening effort or is better for intelligibility than the accurately transmitted signal.

According to some embodiments, the perceptual objective function of the codec is modified. In other words, embodiments do not explicitly suppress noise, but change the objective such that accuracy is higher in parts of the signal where signal to noise ratio is best. Equivalently, embodiments decrease signal distortion at those parts where SNR is high. Human listeners can then more easily understand the signal. Those parts of the signal which have low SNR are thereby transmitted with less accuracy but, since they contain mostly noise anyway, it is not important to encode such parts accurately. In other words, by focusing accuracy on high SNR parts, embodiments implicitly improve the SNR of the speech parts while decreasing the SNR of noise parts.

Embodiments can be implemented or applied in any speech and audio codec, for example, in such codecs which employ a perceptual model. In effect, according to some embodiments the perceptual weighting function can be modified (or adjusted) based on the noise characteristic. For example, the average spectral envelope of the noise signal can be estimated and used to modify the perceptual objective function.

Embodiments disclosed herein are applicable to speech codecs of the CELP-type (CELP=code-excited linear prediction) or other codecs in which the perceptual model can be expressed by a weighting filter. Embodiments however also can be used in TCX-type codecs (TCX=transform coded excitation) as well as other frequency-domain codecs. Further, a use case of embodiments may be speech coding but embodiments also can be employed more generally in any speech and audio codec. Since ACELP (ACELP =algebraic code excited linear prediction) is a typical application, application of embodiments in ACELP will be described in detail below. Application of embodiments in other codecs, including frequency domain codecs will then be obvious for those skilled in the art.

A conventional approach for noise suppression in speech and audio codecs is to apply it as a separate pre-processing block with the purpose of removing noise before coding. However, by separating it to separate blocks there are two main disadvantages. First, since the noise-suppressor will generally not only remove noise but also distort the desired signal, the codec will thus attempt to encode a distorted signal accurately. The codec will therefore have a wrong target and efficiency and accuracy is lost. This can also be seen as a case of tandeming problem where subsequent blocks produce independent errors which add up. But joint noise suppression and coding embodiments avoid tandeming problems. Second, since the noise-suppressor is conventionally implemented in a separate pre-processing block, computational complexity and delay is high. In contrast to that, since according to embodiments the noise-suppressor is embedded in the codec it can be applied with very low computational complexity and delay. This will be especially beneficial in low-cost devices which do not have the computational capacity for conventional noise suppression.

The description will further discuss application in the context of the AMR-WB codec (AMR-WB=adaptive multi-rate wideband), because that is at the date of writing the most commonly used speech codec. Embodiments can readily be applied on top of other speech codecs as well, such as 3GPP Enhanced Voice Services or G.718. Note that a usage of embodiments may be an add-on to existing standards since embodiments can be applied to codecs without changing the bitstream format.

Figure 2A:
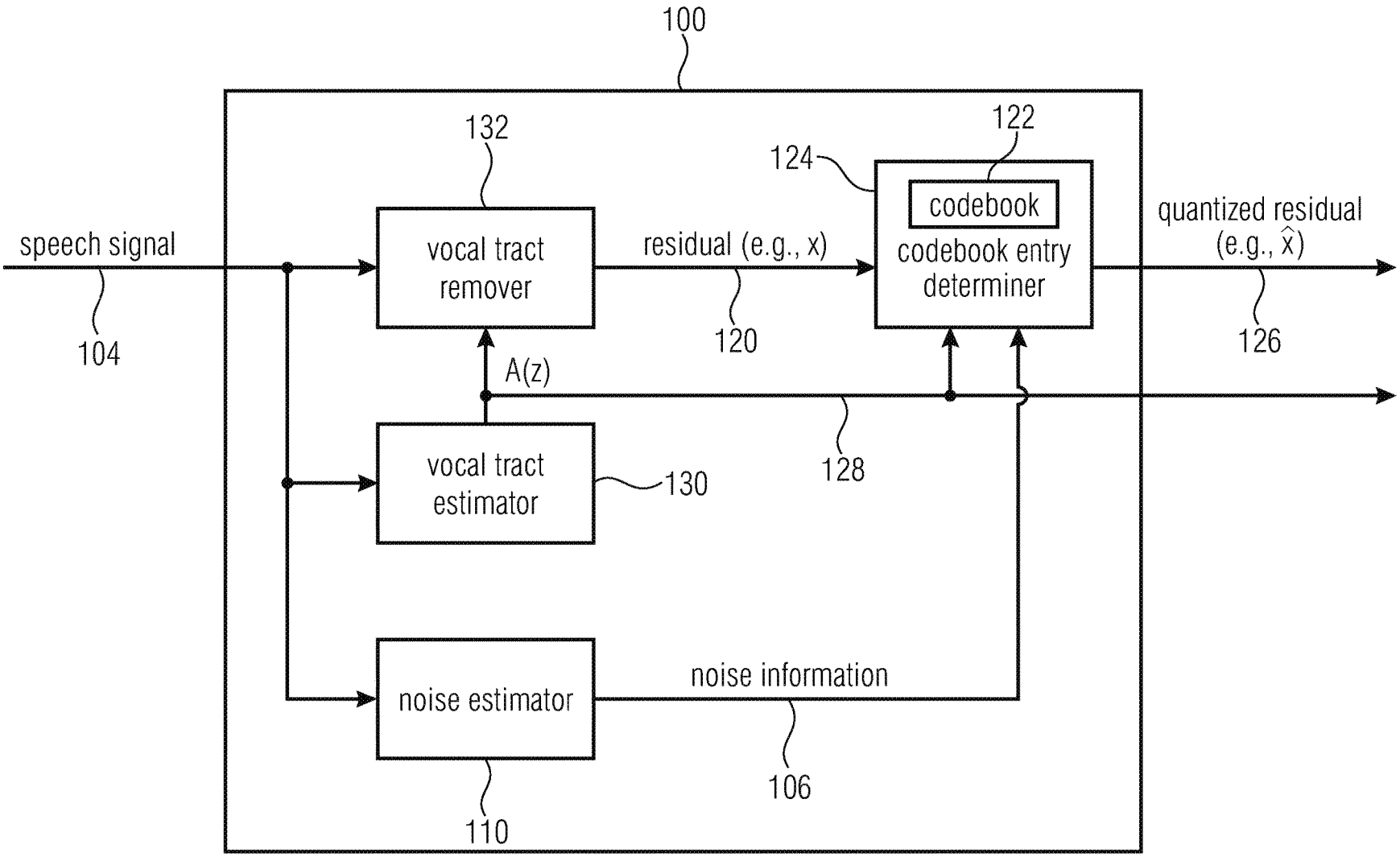
FIG. 2*a* shows a schematic block diagram of an audio encoder for providing an encoded representation on the basis of a speech signal, according to an embodiment.

FIG. 2*a* shows a schematic block diagram of an audio encoder 100 for providing an encoded representation 102 on the basis of the speech signal 104, according to an embodiment. The audio encoder 100 can be configured to derive a residual signal 120 from the speech signal 104 and to encode the residual signal 120 using a codebook 122. In detail, the audio encoder 100 can be configured to select a codebook entry of a plurality of codebook entries of the codebook 122 for encoding the residual signal 120 in dependence on the noise information 106. For example, the audio encoder 100 can comprise a codebook entry determiner 124 comprising the codebook 122, wherein the codebook entry determiner 124 can be configured to select a codebook entry of a plurality of codebook entries of the codebook 122 for encoding the residual signal 120 in dependence on the noise information 106, thereby obtaining a quantized residual 126.

The audio encoder 100 can be configured to estimate a contribution of a vocal tract on the speech signal 104 and to remove the estimated contribution of the vocal tract from the speech signal 104 in order to obtain the residual signal 120. For example, the audio encoder 100 can comprise a vocal tract estimator 130 and a vocal tract remover 132. The vocal tract estimator 130 can be configured to receive the speech signal 104, to estimate a contribution of the vocal tract on the speech signal 104 and to provide the estimated contribution of the vocal tract 128 on the speech signal 104 to the vocal tract remover 132. The vocal tract remover 132 can be configured to remove the estimated contribution of the vocal tract 128 from the speech signal 104 in order to obtain the residual signal 120. The contribution of the vocal tract on the speech signal 104 can be estimated, for example, using linear prediction.

The audio encoder 100 can be configured to provide the quantized residual 126 and the estimated contribution of the vocal tract 128 (or filter parameters describing the estimated contribution 128 of the vocal tract 104) as encoded representation on the basis of the speech signal (or encoded speech signal).

Figure 2B:
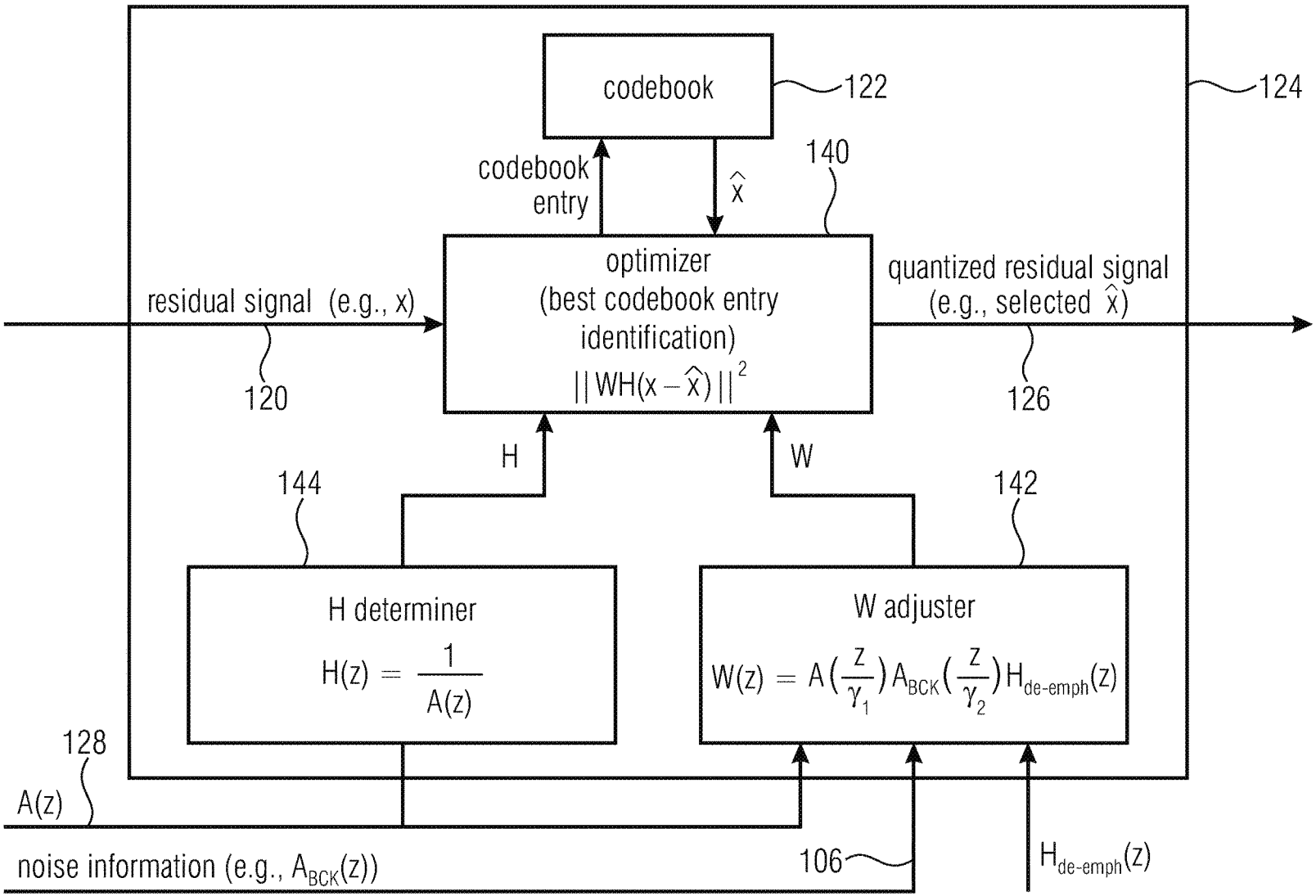
FIG. 2*b* shows a schematic block diagram of a codebook entry determiner, according to an embodiment.

FIG. 2*b* shows a schematic block diagram of the codebook entry determiner 124 according to an embodiment. The codebook entry determiner 124 can comprise an optimizer 140 configured to select the codebook entry using a perceptual weighting filter W. For example, the optimizer 140 can be configured to select the codebook entry for the residual signal 120 such that a synthesized weighted quantization error of the residual signal 126 weighted with the perceptual weighting filter W is reduced (or minimized). For example, the optimizer 130 can be configured to select the codebook entry using the distance function:

$$\|WH(x-\hat{x})\|^2$$

wherein x represents the residual signal, wherein $\hat{x}$ represents the quantized residual signal, wherein W represents the perceptual weighting filter, and wherein H represents a quantized vocal tract synthesis filter. Thereby, W and H can be convolution matrices.

The codebook entry determiner 124 can comprise a quantized vocal tract synthesis filter determiner 144 configured to determine a quantized vocal tract synthesis filter H from the estimated contribution of the vocal tract A(z).

Further, the codebook entry determiner 124 can comprise a perceptual weighting filter adjuster 142 configured to adjust the perceptual weighting filter W such that an effect of the noise on the selection of the codebook entry is reduced. For example, the perceptual weighting filter W can be adjusted such that parts of the speech signal that are less affected by the noise are weighted more for the selection of the codebook entry than parts of the speech signal that are more affected by the noise. Further (or alternatively), the perceptual weighting filter W can be adjusted such that an error between the parts of the residual signal 120 that are less affected by the noise and the corresponding parts of the quantized residual 126 signal is reduced.

The perceptual weighting filter adjuster 142 can be configured to derive linear prediction coefficients from the noise information (106), to thereby determine a linear prediction fit (A_BCK), and to use the linear prediction fit (A_BCK) in the perceptual weighting filter (W). For example, perceptual weighting filter adjuster 142 can be configured to adjust the perceptual weighting filter W using the formula:

$$W(z)=A(z/\gamma_1)A_{BCK}(z/\gamma_2)H_{de\text{-}emph}(z)$$

wherein W represents the perceptual weighting filter, wherein A represents a vocal tract model, $A_{BCK}$ represents the linear prediction fit, $H_{de\text{-}emph}$ represents a de-emphasis filter, $\gamma_1=0.92$, and $\gamma_2$ is a parameter with which an amount of noise suppression is adjustable. Thereby, $H_{de\text{-}emph}$ can be equal to $1/(1-0.68z^{-1})$.

In other words, the AMR-WB codec uses algebraic code-excited linear prediction (ACELP) for parametrizing the speech signal 104. This means that first the contribution of the vocal tract, A(z), is estimated with linear prediction and removed and then the residual signal is parametrized using an algebraic codebook. For finding the best codebook entry, a perceptual distance between the original residual and the codebook entries can be minimized. The distance function can be written as $\|WH(x-\hat{x})\|^2$, where x and $\hat{x}$ are the original and quantized residuals, W and H are the convolution matrices corresponding, respectively, to $H(z)=1/\hat{A}(z)$, the quantized vocal tract synthesis filter and W(z), the perceptual weighting, which is typically chosen as $W(z)=A(z/\gamma_1)H_{de\text{-}emph}(z)$ with $\gamma_1=0.92$. The residual x has been computed with the quantized vocal tract analysis filter.

In an application scenario, additive far-end noise may be present in the incoming speech signal. Thus, the signal is $y(t)=s(t)+n(t)$. In this case, both the vocal tract model, A(z), and the original residual contain noise. Starting from the simplification of ignoring the noise in the vocal tract model and focusing on the noise in the residual, the idea (according to an embodiment) is to guide the perceptual weighting such that the effects of the additive noise are reduced in the selection of the residual. Whereas normally the error between the original and quantized residual is wanted to resemble the speech spectral envelope, according to embodiments the error in the region which is considered more robust to noise is reduced. In other words, according to embodiments, the frequency components that are less corrupted by the noise are quantized with less error whereas components with low magnitudes which are likely to contain errors from the noise have a lower weight in the quantization process.

Figure 3:
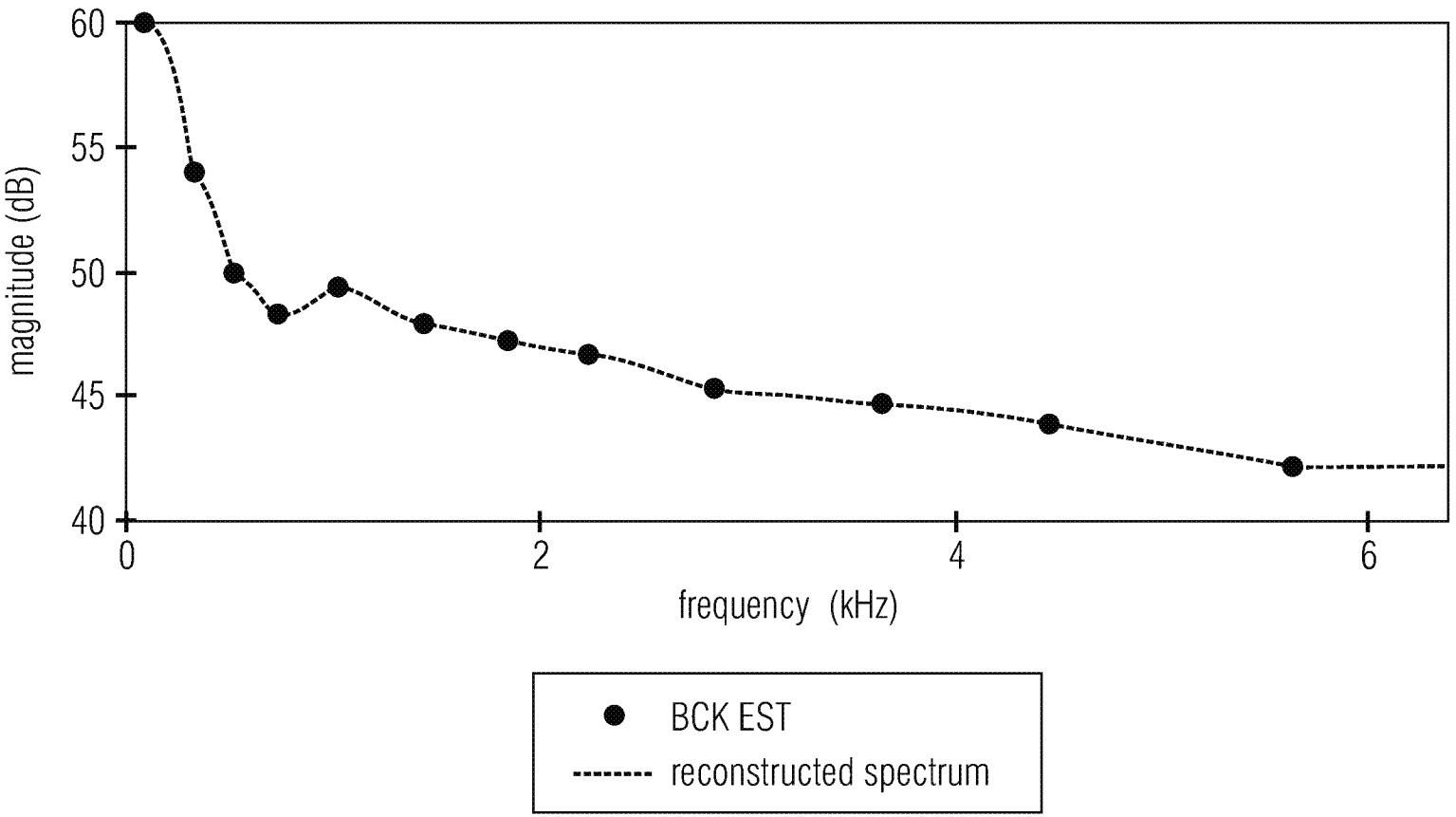
FIG. 3 shows in a diagram a magnitude of an estimate of the noise and a reconstructed spectrum for the noise plotted over frequency.
Figure 4:
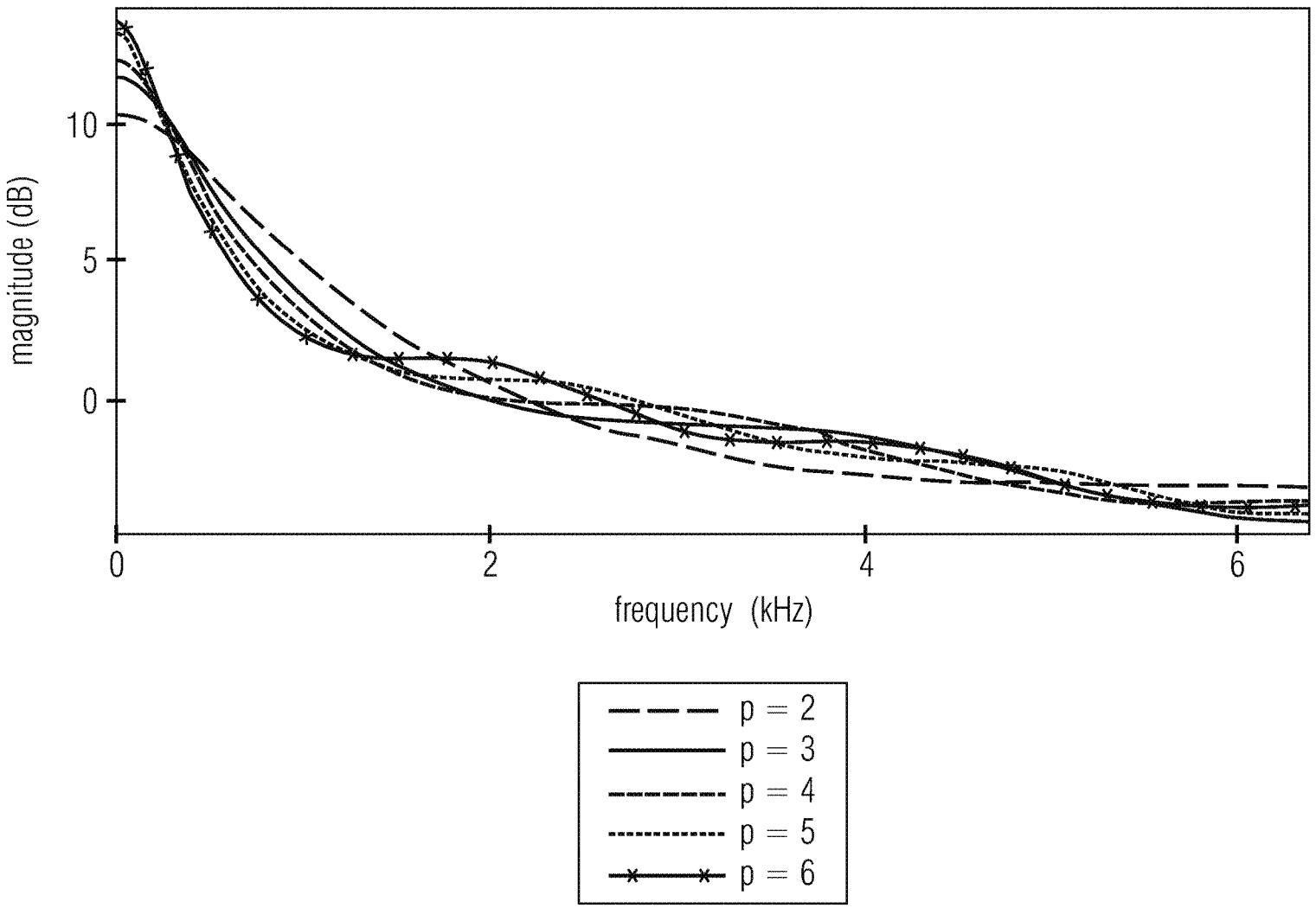
FIG. 4 shows in a diagram a magnitude of linear prediction fits for the noise for different prediction orders plotted over frequency.

To take into account the effect of noise on the desired signal, first an estimate of the noise signal is needed. Noise estimation is classic topic for which many methods exist. Some embodiments provide a low-complexity method according to which information that already exists in the encoder is used. In an approach, the estimate of the shape of the background noise which is stored for the voice activity detection (VAD) can be used. This estimate contains the level of the background noise in 12 frequency bands with increasing width. A spectrum can be constructed from this estimate by mapping it to a linear frequency scale with interpolation between the original data points. An example of the original background estimate and the reconstructed spectrum is shown in FIG. 3. In detail, FIG. 3 shows the original background estimate and the reconstructed spectrum for car noise with average SNR −10 dB. From the reconstructed spectrum the autocorrelation is computed and used to derive the pth order linear prediction (LP) coefficients with the Levinson-Durbin recursion. Examples of the obtained LP fits with p=2 . . . 6 are shown in FIG. 4. In detail, FIG. 4 shows the obtained linear prediction fits for the background noise with different prediction orders (p=2 . . . 6). The background noise is car noise with average SNR −10 dB.

The obtained LP fit, $A_{BCK}(z)$ can be used as part of the weighting filter such that the new weighting filter can be calculated to $$W(z)=A(z/\gamma_1)A_{BCK}(z/\gamma_2)H_{de\text{-}emph}(z).$$

Here $\gamma_2$ is a parameter with which the amount of noise suppression can be adjusted. With $\gamma_2 \rightarrow 0$ the effect is small, while for $\gamma_2 \approx 1$ a high noise suppression can be obtained.

Figure 5:
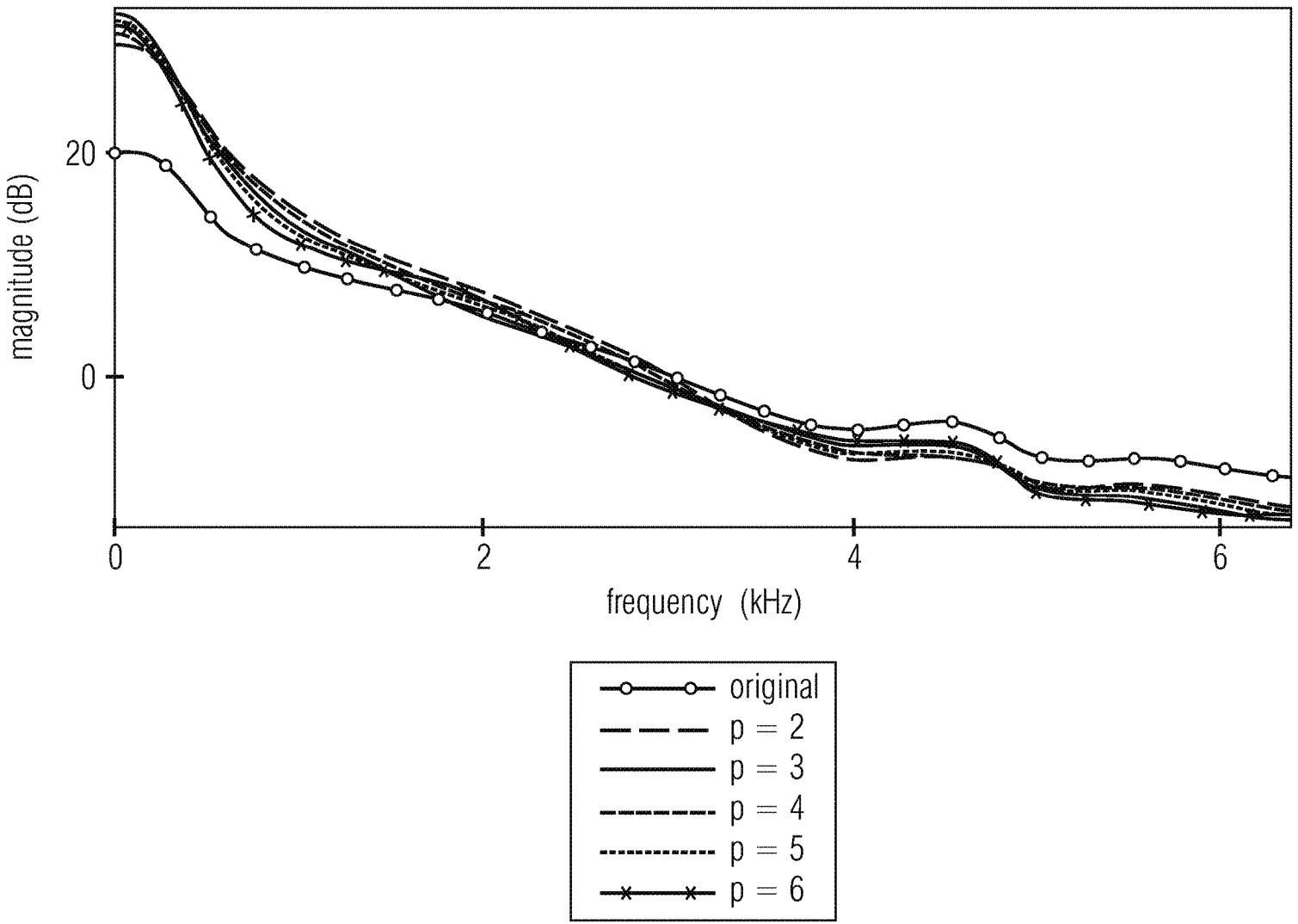
FIG. 5 shows in a diagram a magnitude of an inverse of an original weighting filter and magnitudes of inverses of proposed weighting filters having different prediction orders plotted over frequency.

In FIG. 5, an example of the inverse of the original weighting filter as well as the inverse of the proposed weighting filter with different prediction orders is shown. For the figure, the de-emphasis filter has not been used. In other words, FIG. 5 shows the frequency responses of the inverse of the original and the proposed weighting filters with different prediction orders. The background noise is car noise with average SNR −10 dB.

Figure 6:
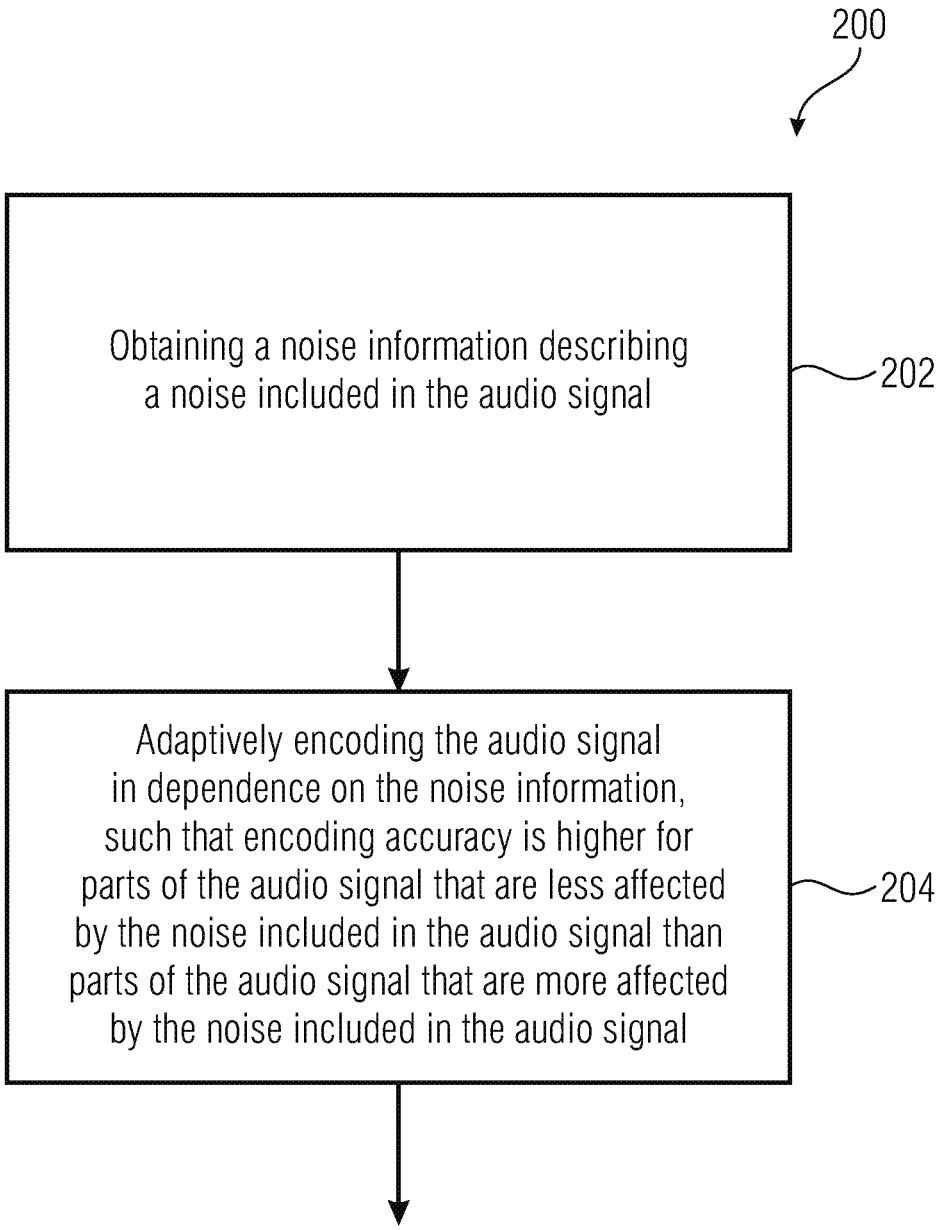
FIG. 6 shows a flow chart of a method for providing an encoded representation on the basis of an audio signal, according to an embodiment.

FIG. 6 shows a flow chart of a method for providing an encoded representation on the basis of an audio signal. The method comprises a step 202 of obtaining a noise information describing a noise included in the audio signal. Further, the method 200 comprises a step 204 of adaptively encoding the audio signal in dependence on the noise information such that encoding accuracy is higher for parts of the audio signal that are less affected by the noise included in the audio signal than parts of the audio signal that are more affected by the noise included in the audio signal.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An audio encoder apparatus for providing an encoded representation on the basis of an audio signal, wherein the audio encoder is configured to acquire a noise information describing a noise comprised by the audio signal, and wherein the audio encoder is configured to adaptively encode the audio signal in dependence on the noise information, such that encoding accuracy is higher for parts of the audio signal that are less affected by the noise comprised by the audio signal than for parts of the audio signal that are more affected by the noise comprised by the audio signal;

wherein the audio signal is a speech signal, and wherein the audio encoder is configured to derive a residual signal from the speech signal and to encode the residual signal using a codebook;

wherein the audio encoder is configured to select a codebook entry of a plurality of codebook entries of a codebook for encoding the residual signal in dependence on the noise information;

wherein the audio encoder is configured to select the codebook entry using a perceptual weighting filter;

wherein the audio encoder is configured to adjust the perceptual weighing filter such that parts of the speech signal that are less affected by the noise are weighted more for the selection of the codebook entry than parts of the speech signal that are more affected by the noise.

2. The audio encoder apparatus according to claim 1, wherein the audio encoder is configured to adaptively encode the audio signal by adjusting a perceptual objective function used for encoding the audio signal in dependence on the noise information.

3. The audio encoder apparatus according to claim 1, wherein the audio encoder is configured to simultaneously encode the audio signal and reduce the noise in the encoded representation of the audio signal, by adaptively encoding the audio signal in dependence on the noise information.

4. The audio encoder apparatus according to claim 1, wherein the noise information is a signal-to-noise ratio.

5. The audio encoder apparatus according to claim 1, wherein the noise information is an estimated shape of the noise comprised by the audio signal.

6. The audio encoder apparatus according to claim 1, wherein the audio encoder is configured to estimate a contribution of a vocal tract on the speech signal, and to remove the estimated contribution of the vocal tract from the speech signal in order to acquire the residual signal.

7. The audio encoder apparatus according to claim 6, wherein the audio encoder is configured to estimate the contribution of the vocal tract on the speech signal using linear prediction.

8. The audio encoder apparatus according to claim 1, wherein the audio encoder is configured to adjust the perceptual weighting filter such that an effect of the noise on the selection of the codebook entry is reduced.

9. The audio encoder apparatus according to claim 1, wherein the audio encoder is configured to adjust the perceptual weighting filter such that an error between the parts of the residual signal that are less affected by the noise and the corresponding parts of a quantized residual signal is reduced.

10. The audio encoder apparatus according to claim 1, wherein the audio encoder is configured to select the codebook entry for the residual signal such that a synthesized weighted quantization error of the residual signal weighted with the perceptual weighting filter is reduced.

11. The audio encoder apparatus according to claim 1, wherein the audio encoder is configured to select the codebook entry using the distance function:

$$\|WH(x-\hat{x})\|^2$$

wherein x represents the residual signal, wherein $\hat{x}$ represents the quantized residual signal, wherein W represents the perceptual weighting filter, and wherein H represents a quantized vocal tract synthesis filter.

12. The audio encoder apparatus according to claim 1, wherein the audio encoder is configured to use an estimate of a shape of the noise which is available in the audio encoder for voice activity detection as the noise information.

13. The audio encoder apparatus according to claim 1, wherein the audio encoder is configured to derive linear prediction coefficients from the noise information, to thereby determine a linear prediction fit ($A_{BCK}$), and to use the linear prediction fit ($A_{BCK}$) in the perceptual weighting filter.

14. The audio encoder apparatus according to claim 13, wherein the audio encoder is configured to adjust the perceptual weighting filter using the formula:

$$W(z)=A(z/\gamma_1)A_{BCK}(z/\gamma_2)H_{de\text{-}emph}(z)$$

wherein W represents the perceptual weighting filter, wherein A represents a vocal tract model, $A_{BCK}$ represents the linear prediction fit, $H_{de\text{-}emph}$ represents a quantized vocal tract synthesis filter, $\gamma_1=0.92$, and $\gamma_2$ is a parameter with which an amount of noise suppression is adjustable.

15. A method for providing an encoded representation on the basis of an audio signal, wherein the method comprises:

acquiring a noise information describing a noise comprised by the audio signal; and adaptively encoding the audio signal in dependence on the noise information, such that encoding accuracy is higher for parts of the audio signal that are less affected by the noise comprised by the audio signal than parts of the audio signal that are more affected by the noise comprised by the audio signal, wherein frequency components that are less corrupted by the noise are quantized with less error whereas components which are likely to comprise errors from the noise comprising a lower weight in the quantization process; wherein the audio signal is a speech signal, deriving a residual signal from the speech signal, encoding the residual signal using a codebook;

selecting a codebook entry of a plurality of codebook entries of a codebook for encoding the residual signal in dependence on the noise information;

selecting the codebook entry using a perceptual weighting filter;

adjusting the perceptual weighing filter such that parts of the speech signal that are less affected by the noise are weighted more for the selection of the codebook entry than parts of the speech signal that are more affected by the noise.

16. A non-transitory digital storage medium having a computer program stored thereon to perform the method for providing an encoded representation on the basis of an audio signal, wherein the method comprises:

acquiring a noise information describing a noise comprised by the audio signal; and adaptively encoding the audio signal in dependence on the noise information, such that encoding accuracy is higher for parts of the audio signal that are less affected by the noise comprised by the audio signal than parts of the audio signal that are more affected by the noise comprised by the audio signal, wherein frequency components that are less corrupted by the noise are quantized with less error whereas components which are likely to comprise errors from the noise comprising a lower weight in the quantization process, wherein the audio signal is a speech signal, deriving a residual signal from the speech signal, encoding the residual signal using a codebook;

selecting a codebook entry of a plurality of codebook entries of a codebook for encoding the residual signal in dependence on the noise information;

selecting the codebook entry using a perceptual weighting filter;

adjusting the perceptual weighing filter such that parts of the speech signal that are less affected by the noise are weighted more for the selection of the codebook entry than parts of the speech signal that are more affected by the noise;

when said computer program is run by a computer.

17. An audio encoder apparatus for providing an encoded representation on the basis of an audio signal, wherein the audio encoder is configured to acquire a noise information describing a noise comprised by the audio signal, and wherein the audio encoder is configured to adaptively encode the audio signal in dependence on the noise information, such that encoding accuracy is higher for parts of the audio signal that are less affected by the noise comprised by the audio signal than for parts of the audio signal that are more affected by the noise comprised by the audio signal;

wherein the audio signal is a speech signal, and wherein the audio encoder is configured to derive a residual signal from the speech signal and to encode the residual signal using a codebook;

wherein the audio encoder is configured to select a codebook entry of a plurality of codebook entries of a codebook for encoding the residual signal in dependence on the noise information;

wherein the audio encoder is configured to select the codebook entry using a perceptual weighting filter;

wherein the audio encoder is configured to adjust the perceptual weighting filter such that an effect of the noise on the selection of the codebook entry is reduced.

18. An audio encoder apparatus for providing an encoded representation on the basis of an audio signal, wherein the audio encoder is configured to acquire a noise information describing a noise comprised by the audio signal, and wherein the audio encoder is configured to adaptively encode the audio signal in dependence on the noise information, such that encoding accuracy is higher for parts of the audio signal that are less affected by the noise comprised by the audio signal than for parts of the audio signal that are more affected by the noise comprised by the audio signal;

wherein the audio signal is a speech signal, and wherein the audio encoder is configured to derive a residual signal from the speech signal and to encode the residual signal using a codebook;

wherein the audio encoder is configured to select a codebook entry of a plurality of codebook entries of a codebook for encoding the residual signal in dependence on the noise information;

wherein the audio encoder is configured to select the codebook entry using a perceptual weighting filter;

wherein the audio encoder is configured to adjust the perceptual weighting filter such that an error between the parts of the residual signal that are less affected by the noise and the corresponding parts of a quantized residual signal is reduced.

19. An audio encoder apparatus for providing an encoded representation on the basis of an audio signal, wherein the audio encoder is configured to acquire a noise information describing a noise comprised by the audio signal, and wherein the audio encoder is configured to adaptively encode the audio signal in dependence on the noise information, such that encoding accuracy is higher for parts of the audio signal that are less affected by the noise comprised by the audio signal than for parts of the audio signal that are more affected by the noise comprised by the audio signal;

wherein the audio signal is a speech signal, and wherein the audio encoder is configured to derive a residual signal from the speech signal and to encode the residual signal using a codebook;

wherein the audio encoder is configured to select a codebook entry of a plurality of codebook entries of a codebook for encoding the residual signal in dependence on the noise information;

wherein the audio encoder is configured to select the codebook entry using a perceptual weighting filter;

wherein the audio encoder is configured to select the codebook entry for the residual signal such that a synthesized weighted quantization error of the residual signal weighted with the perceptual weighting filter is reduced.

20. An audio encoder apparatus for providing an encoded representation on the basis of an audio signal, wherein the audio encoder is configured to acquire a noise information describing a noise comprised by the audio signal, and wherein the audio encoder is configured to adaptively encode the audio signal in dependence on the noise information, such that encoding accuracy is higher for parts of the audio signal that are less affected by the noise comprised by the audio signal than for parts of the audio signal that are more affected by the noise comprised by the audio signal;

wherein the audio signal is a speech signal, and wherein the audio encoder is configured to derive a residual signal from the speech signal and to encode the residual signal using a codebook;

wherein the audio encoder is configured to select a codebook entry of a plurality of codebook entries of a codebook for encoding the residual signal in dependence on the noise information;

wherein the audio encoder is configured to use an estimate of a shape of the noise which is available in the audio encoder for voice activity detection as the noise information.

21. An audio encoder apparatus for providing an encoded representation on the basis of an audio signal, wherein the audio encoder is configured to acquire a noise information describing a noise comprised by the audio signal, and wherein the audio encoder is configured to adaptively encode the audio signal in dependence on the noise information, such that encoding accuracy is higher for parts of the audio signal that are less affected by the noise comprised by the audio signal than for parts of the audio signal that are more affected by the noise comprised by the audio signal;

wherein the audio signal is a speech signal, and wherein the audio encoder is configured to derive a residual signal from the speech signal and to encode the residual signal using a codebook;

wherein the audio encoder is configured to select a codebook entry of a plurality of codebook entries of a codebook for encoding the residual signal in dependence on the noise information;

wherein the audio encoder is configured to derive linear prediction coefficients from the noise information, to thereby determine a linear prediction fit ($A_{BCK}$), and to use the linear prediction fit ($A_{BCK}$) in the perceptual weighting filter.

22. The audio encoder apparatus according to claim 21, wherein the audio encoder is configured to adjust the perceptual weighting filter using the formula:

$$W(z)=A(z/\gamma_1)A_{BCK}(z/\gamma_2)H_{de\text{-}emph}(z)$$

wherein W represents the perceptual weighting filter, wherein A represents a vocal tract model, $A_{BCK}$ represents the linear prediction fit, $H_{de\text{-}emph}$ represents a quantized vocal tract synthesis filter, $\gamma_1=0.92$, and $\gamma_2$ is a parameter with which an amount of noise suppression is adjustable.

* * * * *